US009982540B2

(12) United States Patent
Weaver

(10) Patent No.: US 9,982,540 B2
(45) Date of Patent: May 29, 2018

(54) INTERWOVEN CHANNELS FOR INTERNAL COOLING OF AIRFOIL

(71) Applicant: PURDUE RESEARCH FOUNDATION, West Lafayette, IN (US)

(72) Inventor: Adam M. Weaver, Lafayette, IN (US)

(73) Assignee: PURDUE RESEARCH FOUNDATION, West Lafayette, IN (US)

( * ) Notice: Subject to any disclaimer, the term of this patent is extended or adjusted under 35 U.S.C. 154(b) by 440 days.

(21) Appl. No.: 14/426,910

(22) PCT Filed: Sep. 13, 2013

(86) PCT No.: PCT/US2013/059799

§ 371 (c)(1),
(2) Date: Mar. 9, 2015

(87) PCT Pub. No.: WO2014/043567

PCT Pub. Date: Mar. 20, 2014

(65) Prior Publication Data

US 2015/0218951 A1 Aug. 6, 2015

Related U.S. Application Data

(60) Provisional application No. 61/701,414, filed on Sep. 14, 2012.

(51) Int. Cl.

| | |
|---|---|
| ***F01D 5/18*** | (2006.01) |
| ***F01D 5/14*** | (2006.01) |
| *F01D 25/12* | (2006.01) |

(52) U.S. Cl.
CPC ..... *F01D 5/187* (2013.01); *F01D 5/14* (2013.01); *F01D 25/12* (2013.01);
(Continued)

(58) Field of Classification Search
CPC . F01D 5/186; F01D 5/187; F01D 5/14; F01D 25/12; F05D 2250/611;
(Continued)

(56) References Cited

U.S. PATENT DOCUMENTS

| | | | |
|---|---|---|---|
| 4,080,095 | A | 3/1978 | Stahl |
| 4,684,322 | A | 8/1987 | Clifford et al. |

(Continued)

OTHER PUBLICATIONS

European Patent Office, Communication, EPO Form 1507S, dated Jun. 21, 2016 (1 page).

(Continued)

*Primary Examiner* — Christopher Verdier
(74) *Attorney, Agent, or Firm* — Pauley Erickson & Kolis

(57) ABSTRACT

An apparatus and method for passing fluid flow through at least a portion of a blade of turbomachinery, such as a gas turbine or the like. The fluid flow is directed through a plurality of flow channels which are interwoven with each other. Each flow channel is non-intersecting with any other flow channel and thus does not contact fluid flowing within any other flow channel. The method and apparatus can be used to reduce heat transfer and thus reduce thermal stresses, particularly in the blade.

20 Claims, 7 Drawing Sheets

(52) U.S. Cl.
CPC .. *F05D 2250/183* (2013.01); *F05D 2250/314* (2013.01); *F05D 2250/611* (2013.01); *F05D 2260/2214* (2013.01); *F23R 2900/03043* (2013.01); *F23R 2900/03045* (2013.01)

(58) Field of Classification Search
CPC ..... F05D 2250/314; F05D 2260/2214; F05D 2240/122; F05D 2250/183; F05D 2250/184; F05D 2250/185; F05D 2260/20; F05D 2260/202; F05D 2260/221; F23R 2900/03045; F23R 2900/03043
USPC ..... 415/115; 416/96 R, 96 A, 97 R
See application file for complete search history.

(56) References Cited

U.S. PATENT DOCUMENTS

| | | | | |
|---|---|---|---|---|
| 6,379,118 | B2 * | 4/2002 | Lutum | F01D 5/186 416/97 R |
| 6,402,470 | B1 | 6/2002 | Kvasnak et al. | |
| 7,658,590 | B1 | 2/2010 | Spanks | |
| 7,682,133 | B1 | 3/2010 | Liang | |
| 7,785,071 | B1 | 8/2010 | Liang | |
| 2009/0185903 | A1 | 7/2009 | Beeck et al. | |
| 2011/0171023 | A1 | 7/2011 | Lee et al. | |
| 2011/0243711 | A1 | 10/2011 | Vehr | |

OTHER PUBLICATIONS

European Patent Office, Supplementary European Search Report, EPO Form 1503 03.82, dated Jun. 13, 2016 (1 page).
European Patent Office, Annex to the European Search Report on European Patent Application No. EP 13 83 7759, EPO Form P0459, dated Jun. 13, 2016 (1 page).
European Patent Office, Information on Search Strategy, EPO Form P04A42 (1 page), dated Jun. 13, 2016.
European Patent Office, European Search Opinion, EPO Form 1703 01.91TRI (5 pages), dated Jun. 13, 2016.

* cited by examiner

INTERWOVEN CHANNELS FOR INTERNAL COOLING OF AIRFOIL

CROSS REFERENCE TO RELATED APPLICATION

This application claims the priority benefit of Provisional U.S. patent application, Ser. No. 61/701,414, filed on 14 Sep. 2012. This Provisional U.S. Patent Application Ser. No. 61/701,414, in its entirety, is incorporated by reference into this specification and is made a part hereof, including but not limited to those portions which specifically appear hereinafter.

STATEMENT REGARDING FEDERALLY SPONSORED RESEARCH OR DEVELOPMENT

This invention was made with government support under 101119631/105013 awarded by the United States Department of Energy. The government has certain rights in the invention.

BACKGROUND OF THE INVENTION

Field of the Invention

This invention relates to a method and apparatus for passing fluid flow through a section of a blade, for example, a blade of turbomachinery, turbines, rotating equipment and/or any other suitable or similar piece of equipment.

Discussion of Related Art

To improve efficiency, advanced gas turbines operate at temperatures that far exceed the allowable temperature of component materials. In order to maintain structural integrity and reasonable service life, cooling is needed for components of the engine that contact the hot gasses. Internal cooling, which should be efficient, effective, and uniform is difficult to accomplish throughout the entirety of the turbine. The particularly difficult areas to cool are the leading edges of the airfoils, the trailing edges of the airfoils, the endwalls that sandwich the blades and the vanes, and the blade tips.

The trailing edge, a particularly thin and vulnerable region, requires specific attention in the cooling process. Three main constraints increase the difficulties and challenges in cooling this region. First, the airfoil at this location is very thin, which leaves very little room or space for internal cooling designs without endangering structural integrity. Second, the amount of flow that exits the trailing edge should be minimized. Any flow extracted for internal cooling is not utilized directly for work, and thus represents an inherent loss in overall engine efficiency. It can be desirable to achieve enough of an increase in allowable turbine inlet temperature to offset the cost of coolant extraction. If large enough, the stream of coolant exiting the trailing edge may also disrupt the aerodynamics of the flow about the airfoil. Third, the pressure loss across the trailing edge must be carefully controlled, particularly so that upstream bleed holes operate correctly, while the blowing ratio at the outlet is maintained.

With conventional manufacturing processes, the production of the casting core for the trailing edge is relatively expensive and difficult. This is because the very small core must be machined to the complexity of the cooling geometry through drilling, milling, turning and grinding. These techniques lead to molded geometries that include pin fins, pedestals, ribs, and jet impingement areas. There have been numerous investigations studying the flow and heat transfer through these conventional geometries. Several conventional varied geometries have been investigated, each utilizing the aforementioned enhancement features in different configurations in order to create an increase in surface heat transfer as well as control pressure drop.

Recently, new manufacturing techniques have become available that allow for the production of much higher complexity casting cores without the restrictions of the traditional machining methods. In this way, new advanced cooling designs can be created in the thin geometry of the trailing edge. To date, very few of these advanced designs have been investigated for use in trailing edge cooling.

SUMMARY OF THE INVENTION

One object of this invention is to provide a cooling paradigm or design, sometimes referred to as the Weave design, for cooling thin parts such as the trailing edge of a blade. This object and others are accomplished in at least three parts. First, the Weave design is reduced to a set of components each analyzed separately. Second, a series of conjugate analyses are performed on the Weave design, which will take into account the temperature distribution in the turbine material subjected to different external heat-transfer coefficients and flow rates of the cooling passages. Third, the performance of the Weave design is compared with three other known trailing edge designs.

The trailing-edge region of turbine airfoils is particularly vulnerable to thermal damage. In some embodiments of this invention, the Weave design improves cooling in this thin critical region. This invention uses the CFD conjugate analysis based on the shear-stress transport (SST) turbulence model to explore, develop and assess the Weave design. This invention separately analyzes each of the concepts present in the geometry and their contribution. Performance of the Weave design is compared to three known designs, and the Weave design is shown to provide more effective, efficient, and uniform heat transfer. In assessing performance of the Weave design, the temperature, pressure and mass flow rate were selected to reflect realistic engine operating conditions, and air was modeled as a thermally perfect gas with temperature dependent properties. The nature of the flow induced by design features and how that flow distributes heat transfer to the turbine material and corresponding results are compiled to show overall heat transfer, pressure losses, and mass flow required, as well as temperature distribution within the solid material.

BRIEF DESCRIPTION OF THE DRAWINGS

This invention is explained in greater detail below in view of exemplary embodiments shown in drawings, wherein.

Figure 6:
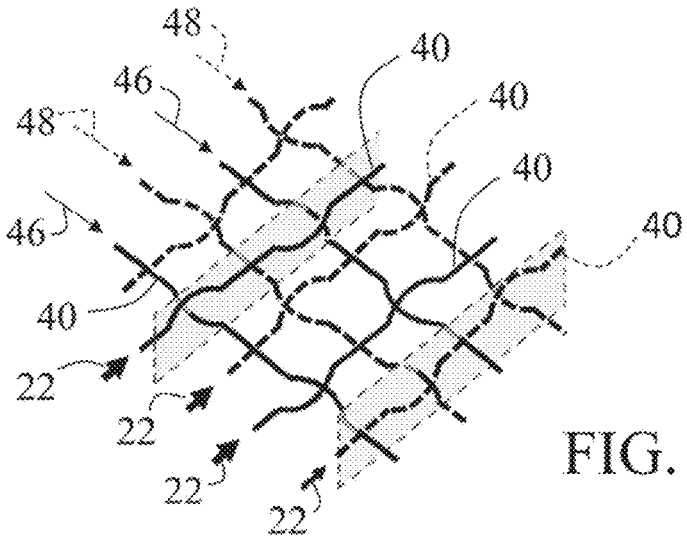
Figure 7:
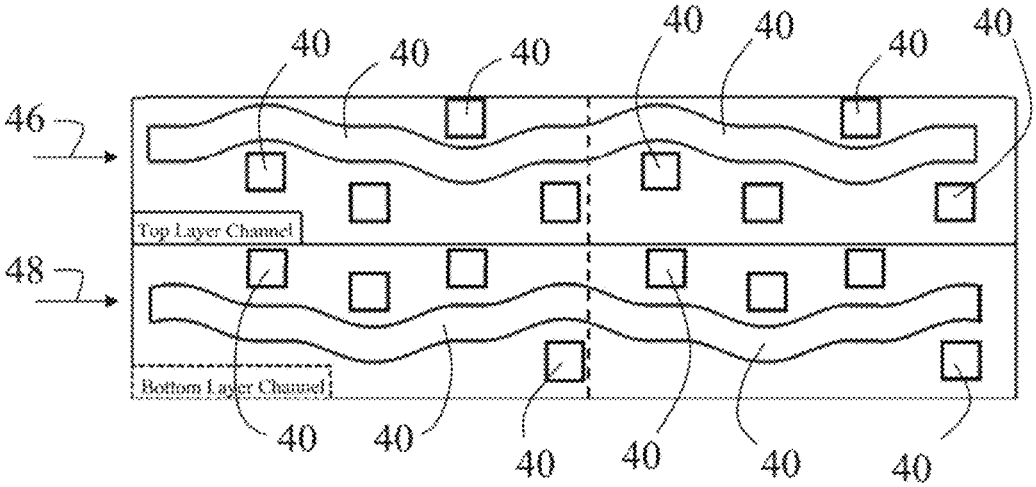
Figure 8:
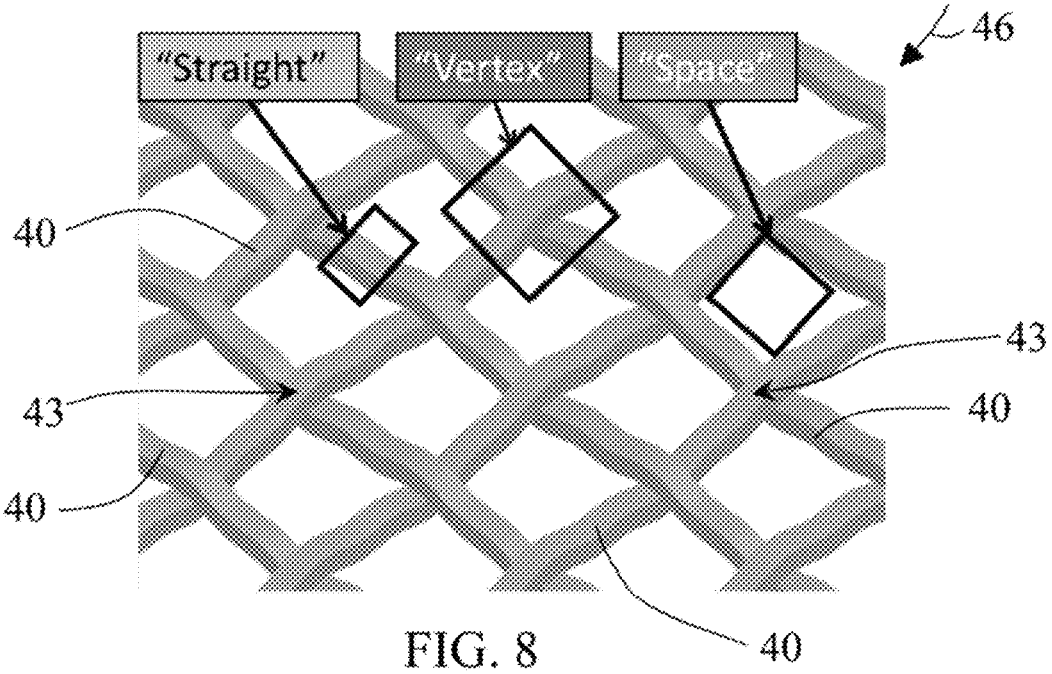
Figure 9:
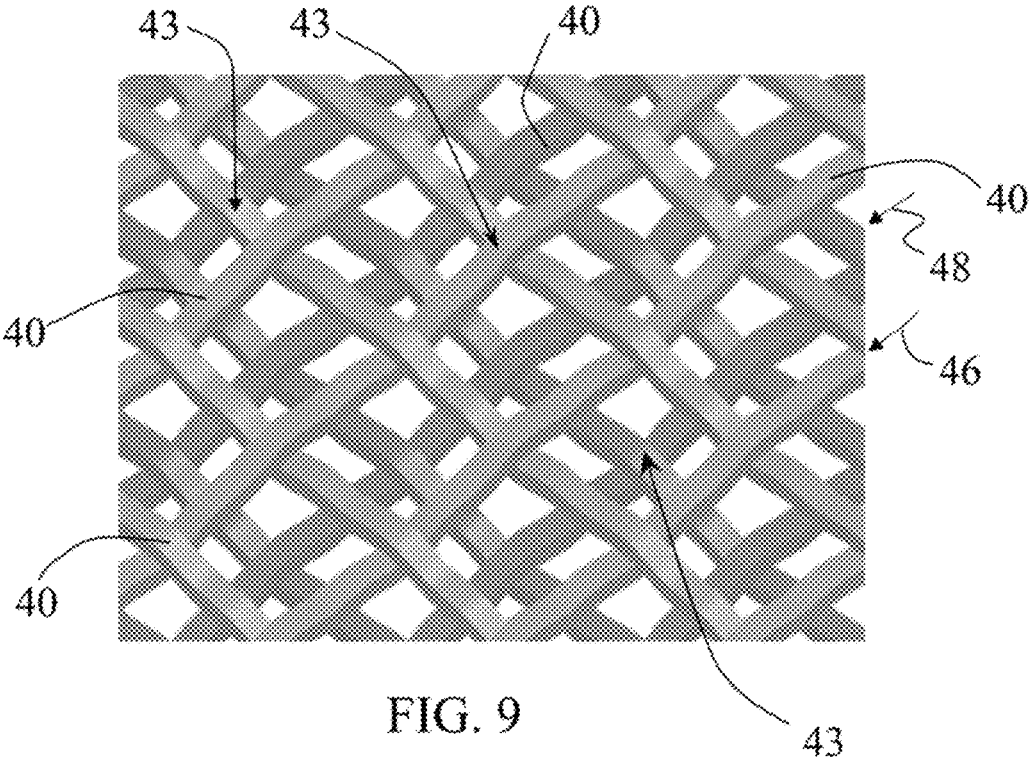
Figure 10:
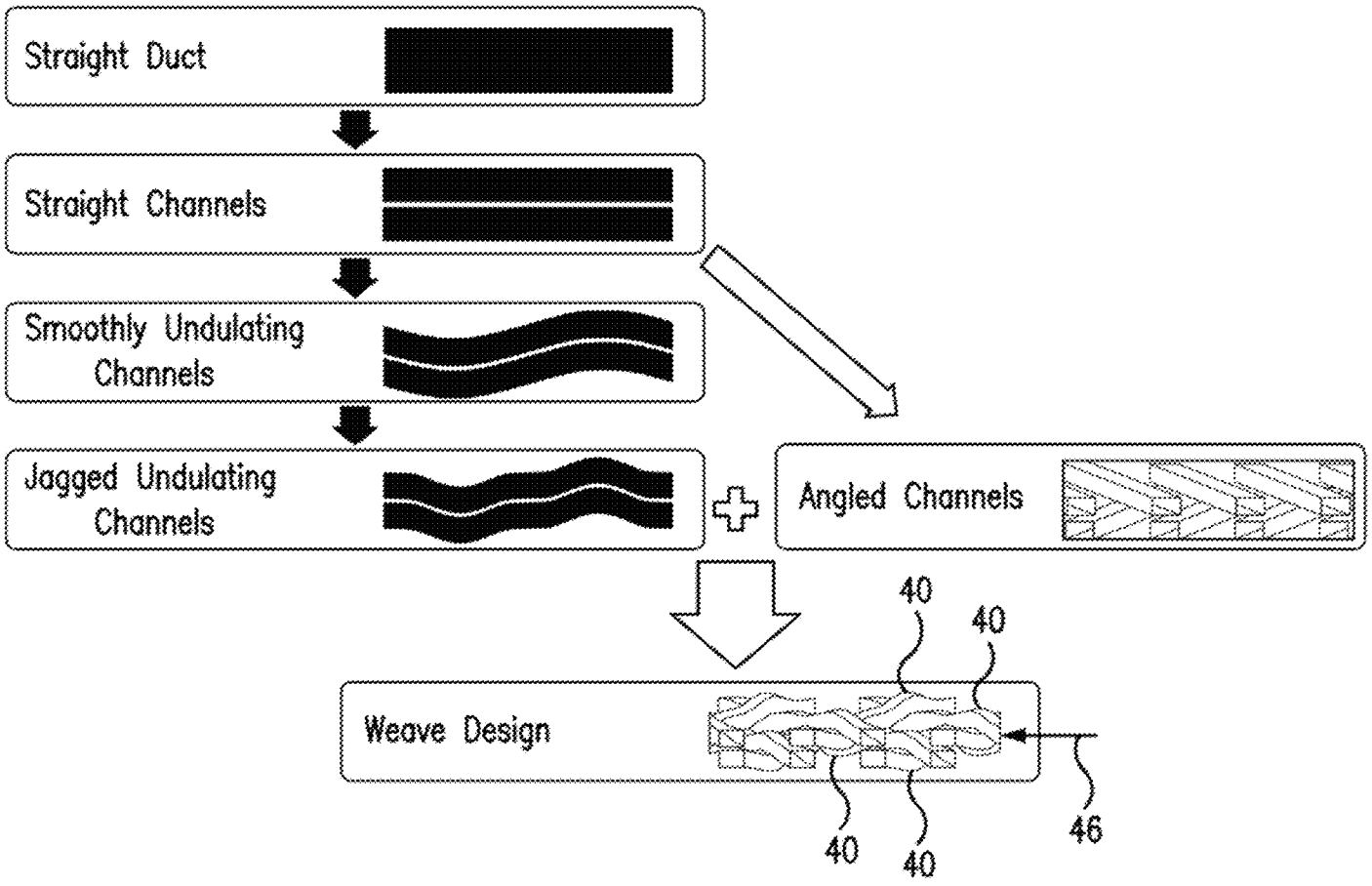
Figure 11:
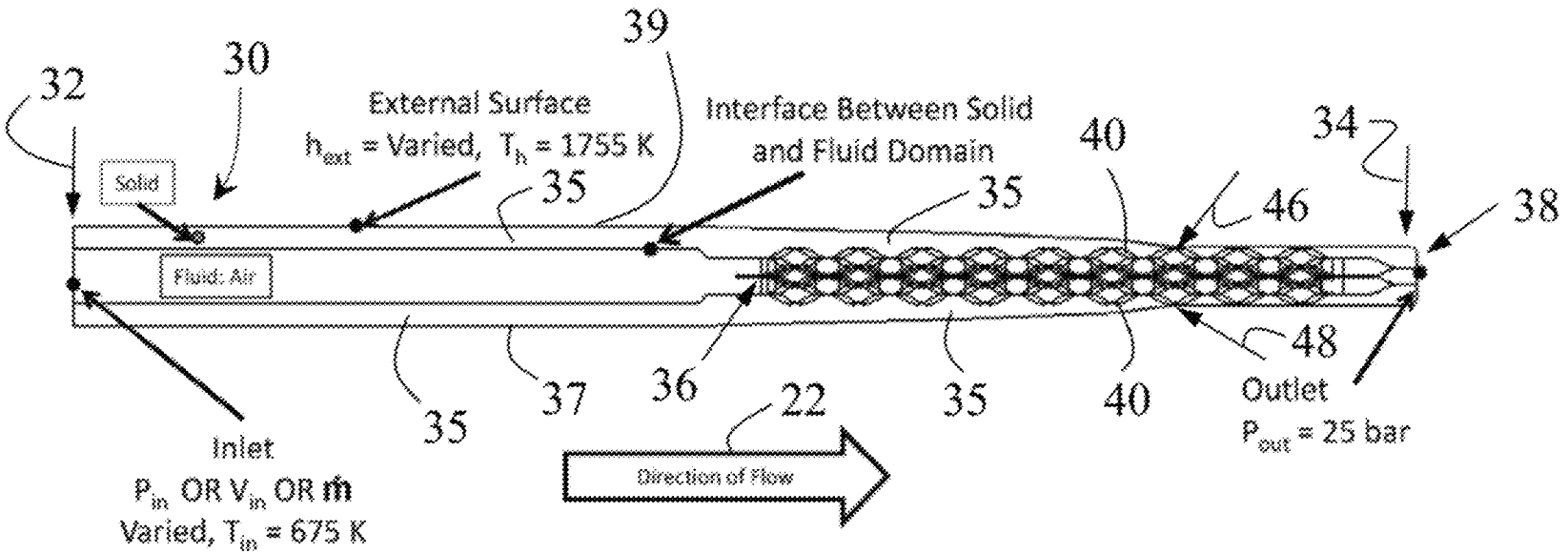
Figure 12:
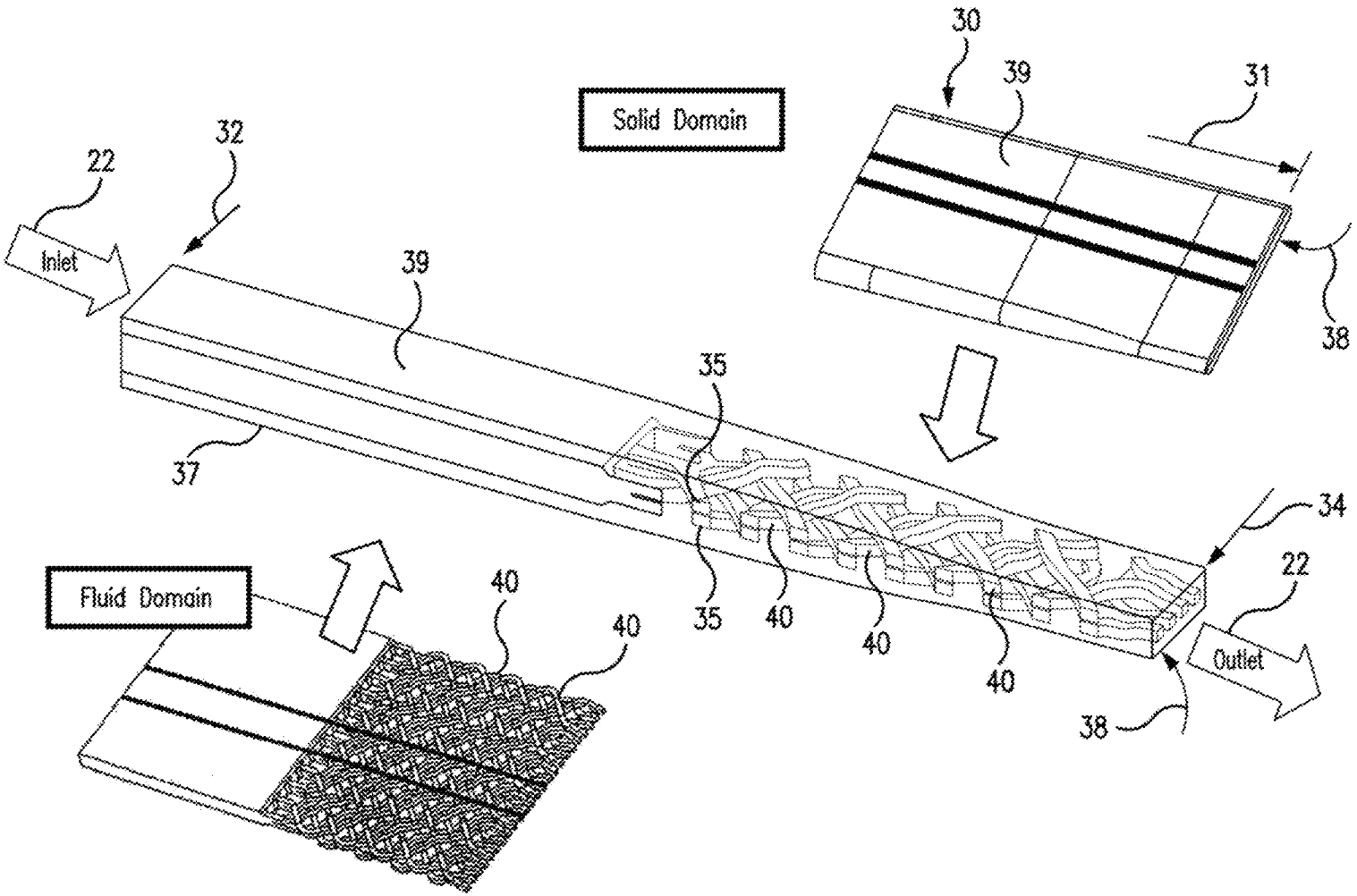
Figure 13:
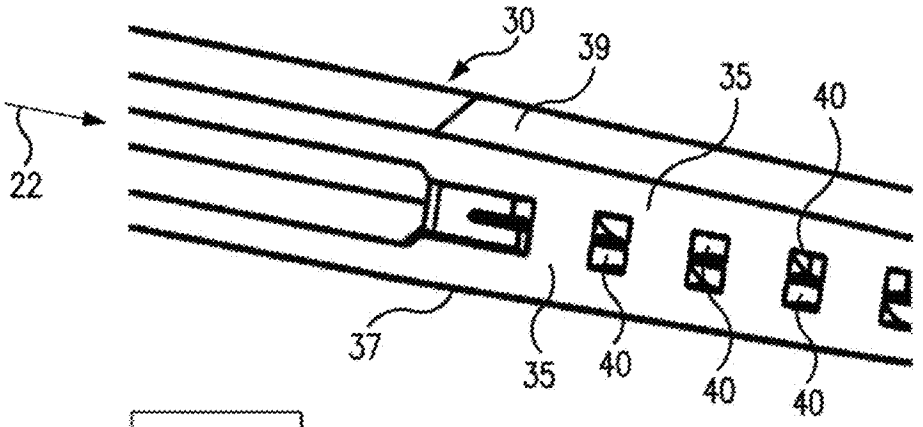
Figure 14:
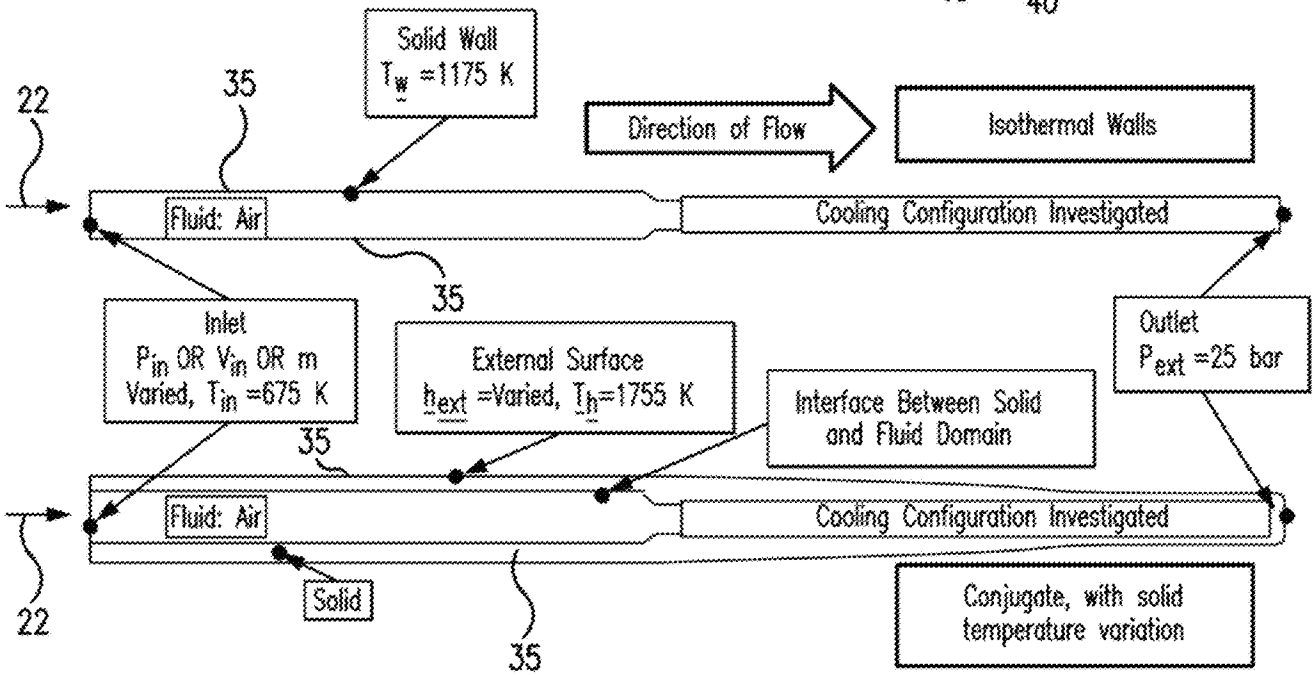

2, and forming a first layer and a second layer of flow channels arranged and configured according to one embodiment of this invention;

FIG. 6 shows a schematic perspective view of two different layers of flow channels, one in solid lines and one in dashed lines, angled at approximately 45° and each having an approximately square cross-section, according to one embodiment of this invention;

FIG. 7 shows a sectional view taken along the shaded area as shown in FIG. 6;

FIG. 8 shows a perspective view of a single layer of interwoven flow channels, according to one embodiment of this invention, including a straight channel section where top and bottom layer flow channels cross approximately horizontally level, a vertex channel section where two flow channels of a same layer of flow channels pass by each other, such as at a crossing location, in a non-intersecting manner, in which one flow channel curves or is angled upward and the other flow channel curves or is angled downward, and a space channel section where the vertex channel section of a different layer, not shown in FIG. 8, can fit or be positioned without intersecting with and/or interfering with any other flow channel, particularly of another layer of flow channels;

FIG. 9 shows a perspective view of a double layer of interwoven flow channels, according to one embodiment of this invention, that includes a first layer and a second layer of flow channels offset with respect to the first layer;

FIG. 10 shows a flowchart of schematic views describing the evolution of interwoven flow channels, according to different embodiments of this invention;

FIG. 11 shows a cross-sectional view of a trailing edge portion or section of a blade, having interwoven flow channels, according to some embodiments of this invention;

FIG. 12 shows a perspective assembly view, including a solid domain of a blade, a fluid domain that flows within upstream voids and downstream flow channels of the section of the blade, and a sectional view taken along the blackened heavy lines shown in the solid domain and in the fluid domain, according to one embodiment of this invention;

FIG. 13 shows a partial perspective cross-sectional view of a section of a blade, including a fluid domain in which fluid flows within upstream voids and downstream flow channels of the section of the blade, according to one embodiment of this invention; and FIG. 14 shows a schematic view of each of two different boundary implementations for solutions with differences illustrated for conjugate simulations and isothermal wall approximations, according to different embodiments of this invention.

DETAILED DESCRIPTION OF THE INVENTION

Figure 1B:
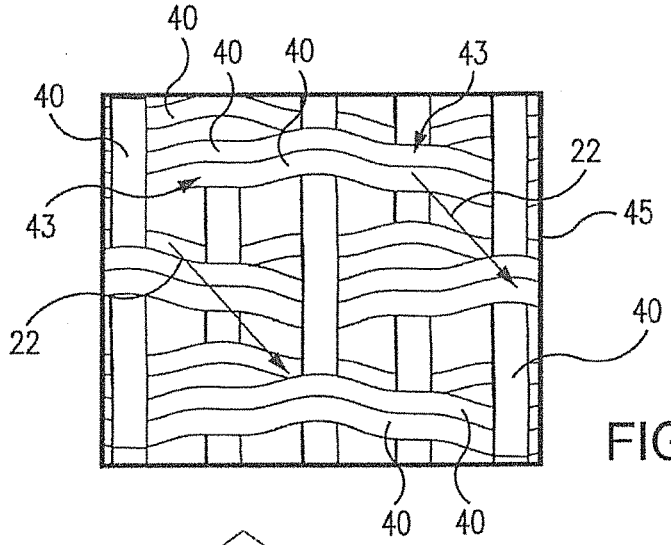
FIG. 1A is a perspective view and FIG. 1B is a view of an associated enlarged section, showing a fluid, such as cooling air, flowing from an upstream end to a downstream end and through a plurality of interwoven flow channels formed by a negative space, such as within a wall of an airfoil or blade, according to one embodiment of this invention.
Figure 1A:
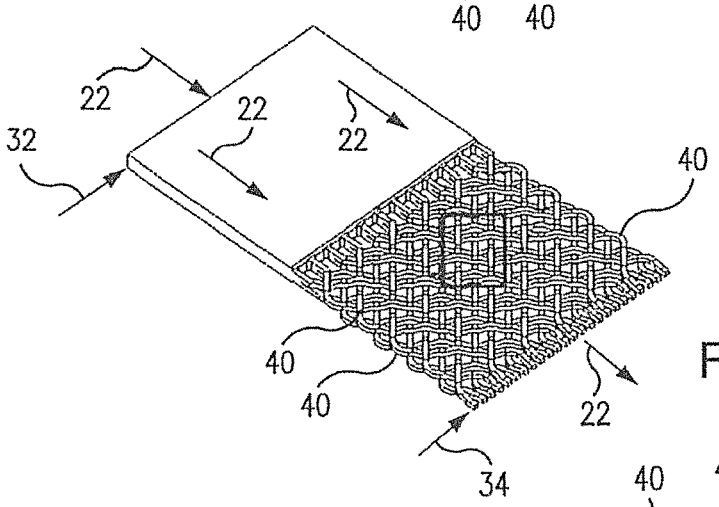
Figure 2:
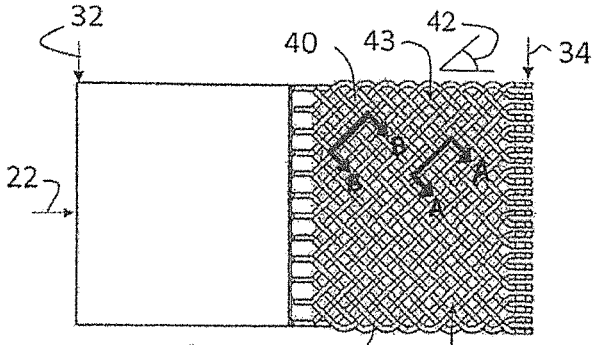
FIG. 2 shows a top view of the fluid flow pattern or fluid domain, as shown in FIG. 1A.

FIGS. 1A and 1B are schematic views of the negative space that forms a fluid domain or a fluid flow profile of the Weave design, according to one embodiment of this invention, comprising an array of non-intersecting fluid channels angled relative to the chord of the blade, each with a square cross-section. In other embodiments of this invention, the fluid channels can have any other suitable shape and/or combinations of shapes for the cross-section of the fluid channel. As used throughout this specification and in the claims, the terms fluid channel, flow channel, channel and coolant passage are intended to be interchangeable with each other and to relate to a passageway and/or other similar void through which fluid can flow.

As shown in FIGS. 1 and 6-9, approximately one-half of fluid channels 40 are angled at approximately +45°, while the other approximately one-half are angled at approximately −45°, causing to separate and corresponding fluid channels 40 to cross at approximately right angles with respect to each other, for example, at or near crossing location 43. Where they would otherwise intersect, the fluid channels 40 curve upwards and downwards in a thickness direction of blade 30, for example to avoid contact with each other. This arrangement, according to one embodiment of this invention, results in fluid channels 40 each having a square cross section, as shown in FIG. 7, and both being interwoven with respect to each other within or through the solid material that forms fluid channels 40.

FIG. 12 shows a cross section of the fluid domain passing through the channeled solid domain of the tail section of blade 30, according to one embodiment of this invention. As shown in FIG. 12, fluid normally flows from upstream end 32 to or towards downstream end 34. FIGS. 1-5, for example, also show the fluid domain passing through flow channels 40, not the structure of blade 30, according to some embodiments of this invention.

In some embodiments of this invention, in a section, for example as shown in FIG. 12, of blade 30, at least a portion of the section forms a plurality of flow channels 40 interwoven with each other. FIG. 11 shows one embodiment of wall 35 of blade 30 forming flow channels 40. FIGS. 6-10 show the interwoven configuration of a plurality of flow channels 40. FIG. 8 shows flow channel 40 having: a straight section or area where a top layer and a bottom layer of flow channels 40 cross, for example, horizontally level; a vertex section or area where two flow channels 40 of a same layer pass by each other, one curving upward and the other curving downward; and a space section or area that forms a void, for example, where the vertex of an adjacent later can be positioned and not interfere.

In the flow direction, each flow channel 40 is non-intersecting with any of the other or remaining flow channels 40. In some embodiments of this invention, each of the non-intersecting flow channels 40 avoids contact with the fluid flowing in any other flow channel 40. Thus, in some embodiments of this invention, each non-intersecting flow channel 40 has completely isolated fluid flow.

Figure 5:
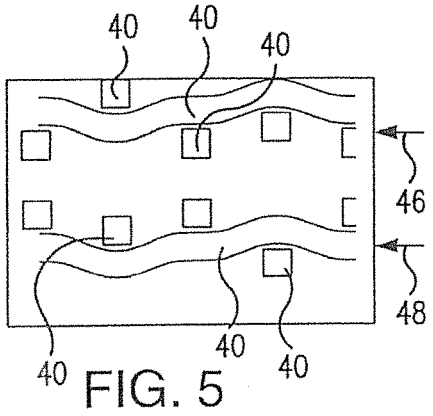
FIG. 5 shows a schematic cross-section, taken through Section A-A and also through Section B-B, as shown in FIG.

FIGS. 5 and 7 show flow channels 40 arranged in first layer 46 and second layer 48. In other embodiments of this invention, flow channels 40 can be arranged in multiple layers with each layer being offset with respect to flow channels 40 of an adjacent layer. With multiple layers, the layers can be alternatingly offset, for example, so that every other layer is aligned with first layer 46 or another reference layer, and every staggered layer can be aligned between, such as approximately midway between, intersections of the reference layer.

In some embodiments of this invention, one or more layers of flow channels 40 are arranged in an array, for example as shown in FIGS. 6-9.

In some embodiments of this invention, flow channels 40 are arranged at an angle of approximately 45° with respect to a chord of blade 30. In some embodiments of this invention, in the flow direction, each flow channel 40 criss-crosses at least one other flow channel 40, for example as shown in FIGS. 1-5. In some embodiments of this invention, the flow channels 40 criss-cross each other at an angle of approximately 90° with respect to each other.

According to some embodiments of this invention, flow divider 36 is positioned at or near upstream end 32. In other embodiments of this invention, one or more alignment nozzles 38 are positioned at downstream end 34.

FIG. 12 shows blades 30 having a pressure side surface 37 and suction side surface 39. In some embodiments of this invention, a thickness of blade 30 is defined as a distance between pressure side surface 37 and suction side surface 39. Along or in the flow direction, an undulating channel section curves upwards and downwards within the thickness of blade 30, which is shown in FIG. 1, for example.

According to some embodiments of this invention, a method for passing fluid flow through a section of blade 30 includes directing the fluid flow in the flow direction along a plurality of flow channels 40 which are interwoven with respect to each other and which also form a non-intersecting flow between each of flow channels 40.

FIGS. 6 and 7 show first layer 46 and second layer 48 which are offset and interwoven fluid channels 40 that comprise and/or complete one of the Weave patterns according to some embodiments of this invention. In addition to ensuring corresponding fluid channels 40 do not intersect with each other, the alternating curvatures in each fluid channel 40, which is also referred to throughout this specification and in the claims as undulations, are designed to cause secondary flows within the fluid flowing through fluid channel 40, which in some embodiments of this invention increases heat transfer effectiveness. Cooling enhancement is thus achieved, in some embodiments of this invention, through induced secondary flows of or within curved fluid channels 40, for example instead of fluid jet interactions, and uniformly distributed via angled fluid channels 40 criss-crossing throughout the solid or other material forming fluid channels 40. In some embodiments of this invention, the amplitudes of the curves of fluid channels 40 are thus constrained by a thickness of blade 30, for example, in the trailing edge region of blade 30. To establish this pattern at the start or beginning of fluid channels 40 according to the Weave design, in some embodiments of this invention, flow divider 36 separates the cross-section of blade 30 into the square channels such as shown in FIG. 7, which are then abruptly turned approximately 45° to enter the woven pattern that corresponds to the array of interwoven fluid channels 40, according to certain embodiments of this invention. FIG. 6 shows a geometry according to one embodiment of this invention, and in other embodiments of this invention any other suitable geometry can be used to accomplish the same result.

In some embodiments of this invention, certain key geometrical features impact and/or contribute to the design of each fluid channel 40. For example, a set of geometries according to certain embodiments of this invention show how constrictions to square fluid channels 40 influence heat flux, show how curved fluid channels 40 enhance secondary flows and show how angled fluid channels 40 evenly distribute temperature throughout the material of blade 30. In some embodiments of this invention the geometries include a rectangular duct, a straight square channel, a smoothly undulating channel, a jagged undulating channel, an angled channel, for example approximately ±45°, and an undulating channel of fluid channel 40 according to some embodiments of the Weave design according to this invention, such as shown in FIG. 10.

Figure 3:
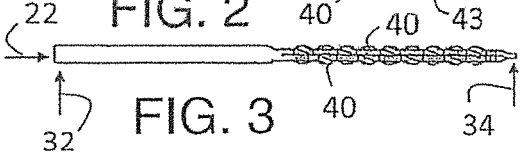
FIG. 3 shows a side view of the fluid flow pattern or fluid domain, as shown in FIG. 1A.

As shown in FIG. 3, according to testing in view of different embodiments of this invention, the square channels geometries constricted the flow to channels with the same cross section as in embodiments of this invention according to the Weave design, but aligned parallel to the chord with two separated layers of straight channels that fit within a thickness of blade 30.

From the square channels, two separate paths of enhancement are examined. First paths turn the channels relative to a chord-wise direction and continue in this way toward the outlet. The top channels are aligned at approximately +45° angles, while the bottom channels are aligned at approximately −45° angles, resulting in even or uniform criss-crossing throughout the solid material of blade 30. When compared to the straight chord-wise channels, in some embodiments of this invention the angled channels are elongated by $\sqrt{2}$.

In a second approach, to enhance heat transfer in some embodiments of this invention, fluid flow is smoothly or jaggedly undulated in the square channels as the fluid flow travels towards the outlet. In some embodiments of this invention, the smooth undulating geometry adds curvature to the aligned square channels concept, for example to match an amplitude and period of fluid flow through channels according to the Weave design. However, the undulations in this geometry are smooth, unlike those of channels according to the Weave design. The jagged undulating concept disrupts the regularity of the undulations so as to match those in the channels according to the Weave design. This is achieved by realigning the channel horizontally between each alternating undulation, while maintaining the period length and the amplitude. FIG. 10 illustrates the difference between smooth and jagged undulations.

These geometries of the coolant passage are constrained by dimensions of or within the relatively thin, tapered trailing edge of a turbine blade. A solid domain can be modeled to replicate this material. For all conjugate simulations, the investigated fluid domain is cut out of this solid domain.

Conditions under which simulations performed for the described geometries are stated. The following specification describes the features in the design, according to certain embodiments of this invention, and the component geometries are analyzed. The following specification also shows how the Weave design of this invention performs under a variety of operating conditions, and also compares performance of the Weave design to three known geometries.

Figure 4:
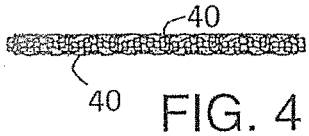
FIG. 4 shows an end view of the fluid flow pattern or fluid domain, as shown in FIG. 1A.

For the geometries shown in FIG. 10, two types of simulations were performed. The first type maintains all walls 35 defining or of the coolant passages at a constant temperature, and the second type allowed a solid temperature variation. These two types of simulations are illustrated in FIG. 4. For the simulations with isothermal walls, the wall 35 temperature was fixed at $T_w$=1,173 K, while for the simulations that allowed solid temperature variation, the temperature of the hot gas flowing outside of the configuration was maintained at $T_{hot}$=1,755 K with a hot-gas heat transfer coefficient set at $h_{ext}$=2,000 W/m$^2$-K. All of the concepts according to different embodiments of this invention were tested for the same inlet conditions, for example: $V_{in}$=10 m/s; $T_i$=673 K.

For the analysis of the geometry according to the Weave design shown in FIGS. 1-5, only conjugate analyses were performed as shown in FIG. 14, with the coolant inlet and hot gas temperatures set at 673 K, and 1755 K, respectively. Three heat-transfer coefficients for hot gas flow were examined: $h_{ext}$=2,000, 4,000, and 6,000 W/m$^2$-K, as well as three inlet conditions, $V_{in}$=5, 10, and 20 m/s.

Three comparison geometries were investigated to provide information on how the Weave design performs relative to alternate designs. For these configurations, conjugate studies were completed as described in FIG. 14 with hot gas heat transfer coefficient $h_{ext}$=2,000 W/m$^2$-K. The inlet conditions varied for each design and were specifically chosen for appropriate head-to-head comparison. These parameters are provided in the corresponding solution sections.

For simulations according to different embodiments of this invention, the coolant was air and the back pressure at the coolant exit was maintained at 25 bars. Due to the periodicity in the configurations, only a symmetric and/or periodic section of the flow domains were considered in the flow analyses. By invoking periodicity, effects from the root and the tip were disregarded.

In a numerical method of solution study, governing equations employed for the gas phase are the ensemble-averaged continuity, compressible Navier-Stokes, and energy equations. The gas was modeled as a thermally perfect gas with temperature-dependent thermal conductivity, viscosity, and specific heats. The effect of turbulence was modeled by using the shear-stress transport (SST) model of Mentor. The solid phase was modeled by the Fourier law with constant thermal conductivity.

Solutions to the governing equations were obtained by using ANSYS CFX Version 13.0. The fully coupled solver algorithm was used to generate solutions for the gas phase. The second-order upwind advection scheme was invoked for all equations, and locally varying blend factors were permitted. Since only steady-state solutions were sought, iterations were continued until residuals for all equations plateaued to ensure convergence had been reached. To aid confidence in the solution, an energy balance metric was employed via the equation $$\epsilon = \frac{\text{energy}_{out} - \text{energy}_{in}}{\int_{wall} q'' \, dA}$$

and simulations continued until the equation stabilized. Values of the convergence levels and energy balances were tabulated.

The tests considered grid systems generated for the gas phase of certain geometries and for comparison geometries. All gas phase grids were composed of structured hexahedral elements, packed near the wall and transitioning smoothly to the center of the channels. Gas phase grid systems used were chosen after individual grid sensitivity studies. For all cases, the y+ of the cell next to the target surface is less than unity so that all governing equations are integrated to the wall, and wall functions were not used.

Solid phase grids were employed wherever conjugate studies were performed. The solid phase grid for the channels according to the Weave design geometry, according to certain embodiments of this invention, is shown in FIG. 14.

According to results of this invention, to assess the SST turbulence model for predicting flow and heat transfer, simulations were performed for a test problem with experimental data. The test problem selected involves a planar jet impinging on a flat plate with two distances between the jet exit and the target wall. For this test problem, a grid independent solution was obtained.

The SST model predicted the Nusselt number on the target surface with considerable accuracy up to x/d of 28 for the case with H/d=6 and up to x/d=4 for the case with H/d=2.6. Outside that range, the accuracy of the prediction was still reasonable. Also, the SST results obtained in this study appeared to be more accurate than those predicted by Yuling, et al. by using the k-ϵ model and the Reynolds stress model. The results of this study give some confidence to the SST model used and the CFD analysis employed in this study.

This section describes the results obtained from the analysis of the Weave design concept geometries described in FIG. 10. For comparison, three important variables were examined: total heat transfer, pressure loss, and mass flow rate. For all of the Weave design concepts geometries studied, the velocity at the inlet of the development duct was the same and the back pressure was the same. With these imposed conditions, the differences in pressure loss and mass flow rate among the geometries was less than 7%. Since pressure loss and mass flow rate are directly related, the Weave design component geometries were assessed on the criteria: increase heat transfer without significantly increasing pressure losses. An increase in pressure loss signifies a cost, while an increase in heat transfer signifies a benefit. Effective utilization is thus described as receiving a high benefit for the cost.

The rectangular duct case represents the baseline for comparison for the rest of the concepts. This high aspect ratio duct achieved a total heat transfer per blade width of 432 W/cm at the cost of 0.002% pressure loss from inlet to outlet. As the boundary layer thickened on the hot surface, it inhibited heat transfer and decreased shear stresses. The following Weave design concept geometries improved upon the heat transfer while expending pressure loss efficiently. This was accomplished by disrupting boundary layers and enhancing secondary flows.

The first of these enhancements, constricting the flow to square channels, more than tripled the heat transfer in the domain, at the cost of 4% pressure loss. Restarted boundary layers were allowed to develop in these straight channels just as they would in a rectangular duct, but with a higher velocity they are thinner. The physical implications of this result are that constricting the flow to increase velocity is a basic method of trading pressure losses for heat transfer. Though not considered, the relative efficiency of this enhancement was expected to deteriorate rapidly with contraction ratio, and may lead to non-uniform cooling. Heat transfer tripled though wall surface area between the square channels and rectangular duct, only increased by 1.67%, which confirms that constricted channels increase heat flux.

The angled channels enhancement increased heat transfer by an additional 26% when compared to square channels. This increase in total heat transfer reflects a 5.9% increase in heat flux, since the internal wall surface area also increased by 19%. The pressure loss for this design is directly related to the length of the channels. The 5.7% pressure loss is 1.4 (or approximately $\sqrt{2}$) times higher than that of the straight square channels. The other significant improvement exhibited by the angled channels concept is the uniformity in which the blade is cooled. Since this benefit cannot be demonstrated by simulations with isothermal wall boundary conditions, a conjugate analysis was performed for this design. The tests compared results of other Weave design concepts which are described later. Plotted curves showed that for each Weave design concept to better indicate temperature variation in the spanwise direction. It was shown that not only does the angled channels concept produce more uniform cooling of the solid, this near uniformity in temperature also increases the magnitude of heat transfer. By angling the channels and allowing them to cross at right angles, the bulk of the solid material is divided much more evenly and cooling flow is applied throughout the blade. This reduction of hot spots through more uniform cooling is important in the alleviation of thermal stresses.

The smoothly undulating channels geometry showed the first concept that acts to constantly disrupt the formation of boundary layers. The curved channels develop secondary flows that act to drive the cooler bulk fluid toward the outside wall. As the undulations occur in this domain, the tendency to form secondary flows with alternate directions encourages fluid mixing and boundary layer disruption. As a result, this concept was shown to increase heat transfer by 13.2% over square channels, while adding 0.7% in pressure loss (from 4.0% to 4.7%).

The disrupted curve regularity in jagged undulating channels resulted in a more frequent change of flow direction, which converts more energy to secondary flow profiles and periodically pushing the boundary layer back to the wall. Both of these contributed to higher heat transfer. When compared to the smoothly undulating geometry, the jagged undulating concept showed a heat transfer improvement of 5.8%, while increasing the pressure loss from 4.7% to 5.6%. A conjugate study was also completed for this jagged undulating design and the resulting external temperature was plotted. Though heat transfer was shown to be high for an isothermal wall simulation, the conjugate simulation shows non-uniformity of cooling. Alleviation of this non-uniformity can be accomplished through the angling of the channels.

The Weave design combines the concepts of jagged undulating channels with that of the angled channels. The jagged undulating channels are angled at approximately ±45° and the undulations ensure no interference. By combining these concepts, it can be seen that the added length of the channels increases residence time and surface area and thus increases total heat transfer as well as uniformity. The jagged nature of the channels constantly disrupts boundary layers and creates secondary flows which lead to more effective heat transfer within these channels. The resulting magnitude and uniformity of heat transfer were examined in view of the external temperature profiles. With this Weave design, all of the previous enhancements according to some embodiments of this invention culminate to provide five times the heat transfer as a rectangular duct, at a cost of 7% pressure loss for the specified inlet velocity.

The parameter $T^*_{out}$ provides one measure of the efficiency of the fluid in extracting energy from the domain. Since the flow rate is nearly constant for all components studied, an increase in outlet temperature signifies a higher heat extraction rate of the coolant. All results presented were based on simulations with isothermal walls.

The bulk temperature ($T_b$) was plotted as a function of chordwise distance (X). $T_b$ functions were 4th order and approximated to fit 50 axial data points through a least-squares method. The data points were gathered using a control volume bulk temperature method.

For all the design concepts studied thus far, once the flow divides into the channels, no jet-to-jet interactions, or mass transfer between channels occurs. The fluid flow according to different embodiments of this invention is entirely constrained to the channel until it is exhausted out of the trailing edge. This is an important design consideration for the Weave design configuration.

According to the basic flow pattern in the Weave design geometry, upstream of the flow divider, the flow is a developing momentum and thermal boundary layer so that it is cool in the middle and hotter in the boundary layer. The curved inlet to the flow divider creates a pair of counter-rotating vortices in each channel, and the sharp turn causes the vortical structure to deform and rotate. These induced flow effects of the inlet region diminish as the flow progresses to the middle or Mid section of the Weave design, where the jagged undulating channel begins to dominate the flow. Once this happens, the undulating channel tends to form alternating pairs of secondary flows, which act to mix and enhance heat transfer. These patterns repeat until the trailing edge, where the square channels realign prior to exiting.

The flow structures and resulting temperature profiles were shown for a representative region of the repeating pattern according to the Weave design. Streamlines were seeded vertically in the middle of the image to show changing velocity profiles throughout the passage. The deformation in the flow, which was indicated by arrows on the streamlines, shows the fluid to have higher velocity along the convex wall of the curved channel. This alternation in the channel curvature causes relatively high wall shear on surfaces where the flow impinges and gets redirected. Wall shear contours are later discussed.

A repeating secondary flow pattern was created by the Weave design geometry and is shown via a series of planes cut perpendicular to the flow. The non-dimensional temperature was plotted on these planes, overlaid with flow streamlines. The secondary flow structures shown can be described as follows. In planes 1-3, the boundary layer grows on the bottom convex surface. Secondary flow induced by the curve tends to drive fluid on the outer edges downward, and the warm fluid on the bottom rises in the center. In planes 4-6, the resulting warmer fluid pocket detaches from the bottom surface. Here, the top surface is now convex, causing boundary layer growth above. The previously formed secondary flow profiles inhibit separation along the center, so warmer fluid from the top wall proceeds downward along edges. In planes 7-9, flow continues downward along the edges from the top surface, which is again convex, while the concave bottom surface is hit by cool inner fluid. In planes 10-12, boundary layer growth switches again to the bottom surface, while the top surface boundary layer is driven back to the wall. The vortices created by the alternate undulations, clearly shown in plane 11, merge and annihilate each other, causing a more complete mixing and leading back into the flow structure seen in plane 1.

The wall shear contours were shown to be derived from the previously discussed flow structures. A comparison of cases was shown to support that an increase in velocity does not cause a change in flow structures. Velocity, instead, simply increases overall wall shear and slightly reduces the relative effects of secondary flow. The two cases were the lowest and highest flowrates investigated. Normalization with respect to inlet conditions was employed, allowing the same scale to be used for both cases. Wall shear is normalized by $$\tau_w/\rho_{in}*U_{in}^2).$$

As expected, wall shear peaks along the surfaces that act to redirect the flow, such as the inner wall at the beginning of curves, the outer wall at the latter half of curves, and the horizontal surfaces on the opposite sides of the previous curves. These high shear locations indicate the areas where the cooler and higher velocity streamtube is driven closer to the surface via momentum effects. Sides with high shear are accompanied by low shear on the sides directly opposite. This pattern was shown in both cases, though as mentioned previously, the higher velocity case reduces the relative effects of swirling and thus appears to level off the peaks and valleys. The high normal velocity leads to more uniformity in the flow and a weaker relative effect of secondary flow.

For the heat transfer normalization, the definition of heat transfer coefficient is used with caution. For situations taking into account heat transfer through a solid material, the current definition of a heat transfer coefficient breaks down. Several locations within the solution cannot accurately be expressed by a heat transfer coefficient calculated via bulk temperature due to two possible scenarios.

The first scenario occurs when the wall drops below the boundary layer fluid temperature while still warmer than the bulk temperature of the fluid, reporting a negative value of heat transfer coefficient. This can occur because the cold bulk of the fluid is extracting large amounts of heat from the solid, and simultaneously reporting a low bulk temperature. Conduction causes the temperature to drop in a localized solid region, a small portion of which is encountering hotter fluid from the developed boundary layer. One example of this occurs around the flow splitter.

In the second scenario, the bulk temperature plane samples fluid that is far away or else not in direct contact with the surface, leading to the wall temperature approaching the measured bulk temperature value. However, cool fluid in contact with the wall may still report high heat flux, resulting in very high heat transfer coefficients. An example of this occurs just after the flow splitter, in regions where two channels pass near to each other.

These two problems occur in very small areas and can occur even if the, often very difficult to define, perpendicular flow plane is perfectly employed to calculate bulk temperature. This is because fluid sampled in this way may be outside of the area of influence for the wall. For the simulations of this invention, the heat transfer coefficients are calculated via the control volume bulk temperature process that was discussed previously.

The resulting heat transfer coefficients for varying inlet velocity were reviewed. The linear scaling of heat transfer coefficient with inlet velocity gives confidence to the concept of heat transfer coefficient calculated in this way, though some local problems can be seen in the contours where the channels cross. As before, it can be seen that the flow structures do not vary significantly between cases of different velocity. However, as velocity increases, hot and cool spots reduce in size, which again shows that the relative effects of swirling are diminished.

The non-dimensional temperatures present in the fluid and solid material when subjected to different flowrates were considered, for example, for the cases where $h_{ext}$=2,000 W/m$^2$-K. Along with temperature contours, plots of T* along the external surface were charted. Of special note here is the uniformity of the cooling; temperature only decreases slightly in the last third of the graph due to the taper of the blade. For a low inlet velocity, the temperature of the fluid nears the wall temperature as it progresses towards the outlet and is no longer effective at cooling. This results in a slight increase in solid temperature from inlet to outlet. This effect diminishes with higher velocity. Since the internal geometry does not taper, the external surface taper ends up resulting in higher heat transfer in the thinner trailing edge portion.

Ramifications of the uniform cooling in the steady-state thermal stresses were reviewed. The conjugate CFD results of the Weave design were used to develop temperature and pressure, while typical mounting constraints were implemented. Expansion was allowed to occur and was measured along the span-wise and chord-wise directions in order to provide estimated results for the real-world blade expansion.

The quantitative comparison of the nine separate cases completed for the Weave design was plotted. Here, the operating map of the design is estimated for: total heat transfer (per 10 mm of blade width), pressure loss, outlet T*, and lengthwise and chord-wise strain. Pressure loss is not significantly affected by external heat transfer, but instead primarily an exponential function of mass flow rate, while total Q and T* are strongly influenced by both external heat transfer and internal flowrate. Strains also responded nearly linearly to internal mass flow rate, and are also a function of external heat transfer, which shows the relative effect of body temperature to the nearly constant pressure forces.

Manufacturing capabilities of producing advanced designs is relatively new. Still, many ideas are already being considered for high precision turbine cooling designs. In order to prove the Weave trailing-edge configuration, three of these advanced concept designs were compared to the Weave design. But before the comparison took place, a full set of desired criteria was defined, as well as a logic map for establishing a verdict or conclusion.

One ability in this regard is for the solid to be effectively and uniformly cooled. This is both for overall efficiency and for alleviation of thermal stresses, which could lead to catastrophic failure of the turbine blade. For this reason, full conjugate heat transfer studies were completed for all of the designs. For a fair comparison, all designs were employed within the same volume of solid material, and inlet passage height, width and length were conserved.

Due to the geometric normalization, a first order analysis was employed using three calculated values: total Q, percent pressure loss, and mass flow rate. Desired performance traits are: high heat transfer, minimal mass flow rate and low pressure loss, though operation of upstream bleed holes requires careful cognizance. Weight functions describing the value of increasing overall Q at the expense of mass flow rate or pressure vary by engine specifications, leading to several indeterminate comparison scenarios; one goal of the comparisons was to select equivalent points on the performance map that fall within definitive proof of relative performance. Thus, not all of the geometries were completed at the same point of the performance map; two competing designs were compared directly. A list of possible scenarios and the corresponding conclusion was provided.

When total Q is viewed as a desired commodity, the mass flow and pressure loss are viewed as costs. By setting one of the two cost variables constant, an increase in the other for a given Q represents a lower value. More pressure or mass flow can always be spent to obtain additional Q, but the transaction will likely be at a similar rate (efficiency). If upstream bleed holes require a specified upstream pressure, selecting a design with higher efficiency and then scaling down the geometrical sizing until the desired pressure loss is achieved will result in even higher heat transfer.

Competing designs were tested by supplying air at variable flowrates and pressures until an equivalent point on the performance map resulted in definitive proof of comparison. All information about inconclusive tests was also provided for comparison. These showed scenarios in which either mass flow rate or inlet pressure were fixed, and help to develop further understanding of the concepts.

Upon completing the first order analysis of the designs, another crucial parameter was investigated, which is the distribution of the heat transfer and resulting uniformity of solid temperature. The Weave design according to some embodiments of this invention had other competing concepts.

Jet impingement has been utilized in one form or another quite extensively (single or double impingement, offset rectangular posts, staggered nozzle arrays, etc.). The particular design used was researched by A. Weaver, J. Liu, T. I-P Shih, et al. The underlying concept of these designs remains very similar. Fluid is accelerated through area contractions and the resulting jet is directed onto a perpendicular wall on the following row of posts. In this way, heavy viscous pressure losses are spent for enhanced heat transfer via the act of driving cooler bulk fluid very close to the opposing perpendicular wall, as well as increasing the heat transfer along the throttling nozzle region, where velocity is greatest.

The triple impingement was compared and the first order analysis of performance, along with a reference measurement to the Weave case ($V_{in}$=10 m/s, $h_{ext}$=2,000 W/m$^2$-K). As expected conceptually, the Triple Impingement case has much greater pressure losses for a matched mass flow rate (Test 3), or conversely, much lower mass flow rate at a specified pressure differential (Test 1). Additionally, the heat transfer rate was incapable of reaching that of the Weave design, for any of the comparisons. Tests 2 and 3 both support inferior performance compared to the Weave design according to this invention. However, tests 1 and 3 show the comparisons with matched pressure loss or mass flow rate, and are thus used to carry on to the next order analysis, which includes the local variance in temperature. Once again, attention was given not only to overall temperature, but the effective cost of either higher mass flow rate, or higher pressure losses.

From these test results, another important distinction becomes apparent: high localized heat transfer on the post rows with low heat transfer around recirculation regions causes a large variation in temperature. The more evenly distributed temperature seen in the Weave design of this invention would greatly alleviate thermal stresses and fatigue in the solid material of the trailing edge.

Mesh, or equivalently square post, structures are another design that is extensively researched for use in turbine blade cooling. The basic concept is that square posts are arranged in staggered rows and angled 45° to the flow direction. What would otherwise be the typical wake region is collapsed by streamtubes deflected off the staggered row. This forms alternating angled flow channels with jet-to-jet interactions just upstream of every row of posts. The resulting jet is highly mixed, and directed at the leading corner of the following post. In this way, constant redirected flow direction and jet-to-jet interactions occur to increase heat transfer at the expense of viscous losses. The variation of the design examined here, called "Multi-Mesh," uses 8 rows of posts at the upstream end before reducing the scale of the posts to half, and including 12 rows of the smaller variation. Curved edges are also employed wherever possible to alleviate any pressure losses that do not contribute to heat transfer.

For specific normalization, the channels between the two designs, the Weave design and the upstream section of Multi-Mesh design, are the same width, and if viewed from the top view, the Weave design appears identical to the upstream sizing of the Multi-Mesh design. Thus, the Weave design can be partially perceived as a mesh design without jet-to-jet interactions and with added channel curvature.

A testing method was used to compare this advanced Multi-Mesh geometry with the Weave design. By first matching the inlet velocity (Test 1), the mass flow rate was slightly higher, due to and accompanied by 2.5 times the pressure loss. The added flowrate also caused a slight increase in heat transfer, leaving this test to be inconclusive, though extraordinarily high pressure loss seems indicative. One simulation (Test 2) matched the mass flow rates of the competing geometries, and resulted in Multi-Mesh showing 2.18 times the pressure loss for a heat transfer rate of 1.5% less than the Weave design. This test shows inferior performance to the Weave design, but one additional test was performed in order to fully describe the range. To understand how the Multi-Mesh design would perform under similar pressure losses, Test 3 allowed the flowrate to change in order to match the inlet pressure to the Weave design. This resulted in much less (17.2%) heat transfer due to a significant reduction in flowrate (39%). By itself, this last test would be inconclusive, but when used in parallel with Test 2, can be used to show comparable points on the operation map.

Temperature profiles for the Multi-Mesh and Weave cooling configurations were shown under both matched mass flow and matched pressure loss scenarios. With the same mass flow rate, the Multi-Mesh design performed very similarly in terms of heat transfer, and even provided locations where external temperatures are lower than that of the Weave design. However, the substantial pressure loss in this scenario shows evidence of inferior performance attributed to less efficient use of the cooling airflow. By the second test, it was shown that in order to maintain the same pressure profiles, the Multi-Mesh design would supply much less flowrate, and thus result in low heat transfer rates. This concludes that the efficiency of the Weave design in converting pressure losses to heat transfer is higher than that of the Multi-Mesh design.

The inherent concept of the Zig-Zag geometry is somewhat similar to that of the Weave design, constrict flow to channels, and bend those channels along the streamwise direction so as to cause secondary flows and drive cool streamtubes to the walls. A few significant differences are: the size of the channels; the amplitude and wavelength of the curves; and the direction of the curves, while Zig-Zag oscillates span-wise, the Weave design undulates in the thickness of the blade. The streamlined nature of this Zig-Zag configuration leads to low pressure losses and strong discernible secondary flows.

These two designs were compared and only required two tests, the first of which was completed by matching the mass flow rate. Heat transfer was lower for Test 1 of the Zig-Zag, as was pressure loss, which proves inconclusive. The second test then matched pressure loss to the Weave design, which allowed mass flow rate for the Zig-Zag to increase 24%. However, the increased flowrate was not enough to make up the difference in total heat transfer, and thus the Weave design outperformed the Zig-Zag design.

The final test of the Zig-Zag design matched pressure loss to the Weave design. The temperature of the solid was greater than that of the Weave design for a majority of the blade, despite having required 24% higher mass flow to achieve that temperature.

The uniformity of the cooling for both the Zig-Zag design and the Weave design are comparable, significant hot spots are not seen.

Some embodiments of the design according to this invention improve cooling in the trailing edge of turbine blades. The CFD study based on steady RANS with and without conjugate solid temperature variation showed that the Weave trailing-edge cooling design utilizes several geometrical concepts with each seeking to efficiently utilize cooling flow within the trailing edge. The independent analyses of each of these features validate heat transfer improvements which all contribute to the design according to different embodiments of this invention. Constricting flow into square channels increased heat transfer significantly at the cost of pressure loss. Angling channels throughout the blade increased residence time as well as uniformity and magnitude of heat transfer. Uneven undulations of the flow passages developed secondary flows which increased the magnitude of heat transfer within channels. The Weave design according to different embodiments of this invention combines all of these concepts.

Conjugate simulations indicate that the Weave design according to this invention acts to uniformly cool the solid material while minimizing pressure loss and mass flow. This was achieved through criss-crossing separate channels and undulating them to create directed wall shear and secondary flows that act to mix the coolant. Results provided describe the range of operating conditions for the Weave design.

In comparison with three existing geometries, a series of conjugate heat transfer studies conclude that the Weave design according to this invention provides more effective, efficient and uniform cooling of this critical region. These conclusions are based on two levels of comparison. The first comparison level measured the efficiency of cooling by measuring total heat transfer for the cost of pressure loss and mass flow. The second comparison level compared the resulting solid temperature profiles along with the relative cost of using the coolant.

While in the foregoing specification this invention has been described in relation to certain preferred embodiments, and many details are set forth for purpose of illustration, it will be apparent to those skilled in the art that this invention is susceptible to additional embodiments and that certain of the details described in this specification and in the claims can be varied considerably without departing from the basic principles of this invention.

What is claimed is:

1. In a section of a blade of turbomachinery, the improvement comprising:

at least a portion of the section forming a plurality of flow channels for fluid flow interwoven with each other, and the fluid flow in a flow direction through each of the flow channels non-intersecting with the fluid flow through any other of the flow channels, wherein the interwoven flow channels comprise;

a single layer of interwoven flow channels including a straight channel section where top and bottom layer flow channels cross horizontally level, a vertex channel section where two flow channels of a same layer of flow channels pass by each other and a space channel section where a vertex channel section of a different layer can be positioned without intersecting with any other flow channel.

2. The improvement of claim 1 wherein the interwoven flow channels are arranged in an array.

3. The improvement of claim 1 wherein the interwoven flow channels are arranged in a plurality of layers with each layer offset with respect to the interwoven flow channels of an adjacent layer.

4. The improvement of claim 1 wherein at least a portion of each of the interwoven flow channels is arranged at an angle of 45° with respect to a chord of the blade.

5. The improvement of claim 1 wherein each of the flow channels avoids contact with any other of the interwoven flow channels.

6. The improvement of claim 1 wherein in the flow direction each of the interwoven flow channels criss-crosses at least one of the other interwoven flow channels.

7. The improvement of claim 1 wherein the flow direction is from an upstream end to a downstream end of the section and a flow divider is positioned at the upstream end.

8. The improvement of claim 1 wherein the flow direction is from an upstream end to a downstream end of the section and a plurality of alignment nozzles are positioned at the downstream end.

9. A section of a blade of turbomachinery, the section comprising:

a wall of the blade forming a plurality of flow channels for fluid flow interwoven with each other, and the fluid flow along a flow direction through each of the flow channels non-intersecting with the fluid flow through another flow channel of the flow channels, wherein the interwoven flow channels comprise;

a single layer of interwoven flow channels including a straight channel section where top and bottom layer flow channels cross horizontally level, a vertex channel section where two flow channels of a same layer of flow channels pass by each other and a space channel section where a vertex channel section of a different layer can be positioned without intersecting with any other flow channel.

10. The section according to claim 9 wherein along the flow direction at least a portion of each of the interwoven flow channels has an undulating channel section that curves within a thickness of the blade.

11. The section according to claim 10 wherein the thickness is a distance between a pressure side surface and a suction side surface of the blade, and along the flow direction the undulating channel section curves upwards and downwards within the thickness.

12. The section according to claim 10 wherein at least a portion of each of the interwoven flow channels is arranged at an angle of 45° with respect to a chord of the blade.

13. The section according to claim 12 wherein at least two of the interwoven flow channels cross each other at 90° with respect to each other.

14. The section according to claim 13 wherein near a crossing location and in the flow direction one of the crossing interwoven flow channels curves upwards and the other of the interwoven flow channels curves downwards.

15. The section according to claim 9 wherein the interwoven flow channels are arranged in a plurality of layers with each layer offset with respect to the interwoven flow channels of an adjacent layer.

16. The section according to claim 9 wherein the flow direction is from an upstream end to a downstream end of the section and a flow divider is positioned at the upstream end.

17. The section according to claim 9 wherein the flow direction is from an upstream end to a downstream end of the section and a plurality of alignment nozzles are positioned at the downstream end.

18. A method for passing a fluid flow through a section of a blade of turbomachinery, including the steps of: directing the fluid flow in a flow direction along a plurality of flow channels interwoven with each other and forming non-intersecting flow between each of the flow channels, wherein the interwoven flow channels comprise;

a single layer of interwoven flow channels including a straight channel section where top and bottom layer flow channels cross horizontally level, a vertex channel section where two flow channels of a same layer of flow channels pass by each other and a space channel section where a vertex channel section of a different layer can be positioned without intersecting with any other flow channel.

19. The method according to claim 18 wherein the fluid flow through each of the interwoven flow channels does not intersect with the fluid flow through any other flow channel of the interwoven flow channels.

20. The method according to claim 18 wherein along the flow direction at least a portion of each of the interwoven flow channels has an undulating channel section that curves upwards and downwards within a thickness of the blade.

* * * * *